US007091435B2

(12) United States Patent
Sato

(10) Patent No.: US 7,091,435 B2
(45) Date of Patent: Aug. 15, 2006

(54) PUSH SWITCH APPARATUS

(75) Inventor: Takashi Sato, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/222,121

(22) Filed: Aug. 30, 2005

(65) Prior Publication Data

US 2006/0049024 A1 Mar. 9, 2006

(30) Foreign Application Priority Data

Sep. 9, 2004 (JP) ..... 2004-262424

(51) Int. Cl.
*H01H 3/12* (2006.01)

(52) U.S. Cl. ..... 200/341; 200/345

(58) Field of Classification Search ..... 200/5 A, 200/517, 520, 296, 341–345; 400/490–496
See application file for complete search history.

(56) References Cited

U.S. PATENT DOCUMENTS 4,351,988 A * 9/1982 Allbright ..... 200/5 A
4,439,646 A * 3/1984 Bouvrande ..... 200/5 A
4,515,999 A * 5/1985 Harper ..... 200/5 A
4,613,737 A * 9/1986 Nishijima ..... 200/342
5,380,970 A 1/1995 Mizuno et al.
5,442,152 A * 8/1995 Huang ..... 200/345
5,938,009 A * 8/1999 Huang ..... 200/517

FOREIGN PATENT DOCUMENTS

JP 2-92620 7/1990
JP 08-50832 2/1996
JP 10-12083 1/1998

* cited by examiner

*Primary Examiner*—Michael A. Friedhofer
(74) *Attorney, Agent, or Firm*—Brinks Hofer Gilson & Lione

(57) ABSTRACT

A push switch apparatus includes a switch that has a movable contact and a fixed contact built therein, a driving body that makes the movable contact contact/separate with/from the fixed contact by pressing the switch, an operating knob that holds the driving body, and a housing that holds the operating knob to be moved in a direction in which the switch is pressed. An elastic member that holds the driving body so as to be moved in the direction in which the switch is pressed and suppresses the driving body and a stopper that regulates the movement of the driving body are provided in the operating knob. The driving body elastically comes into contact with the stopper by the elastic member.

9 Claims, 6 Drawing Sheets

PUSH SWITCH APPARATUS

This application claims the benefit of priority to Japanese Patent Application No. 2004-262424 filed on Sep. 9, 2004, herein incorporated by reference.

BACKGROUND OF THE INVENTION

1. Field of the Invention

The present invention relates to a push switch apparatus, and more particularly, to a push switch apparatus which is capable of obtaining an overstroke after the switch is switched on.

2. Description of the Related Art

A structure of a conventional push switch apparatus has been disclosed (for example, see Japanese Unexamined Utility Model Registration Application Publication No. 2-92620). The push switch apparatus according to the related art has an element switch, in which a fixed contact is exposed from an inner bottom surface of a housing and a movable contact having an inversion spring contacting/separating with/from the fixed contact is housed inside the housing, a key top that ascends and descends along the element switch, and a coil spring that is interposed between the key top and the element switch.

Hereinafter, the structure of the push switch apparatus according to the related art will be described with reference to the drawing.

FIG. 9 is a cross-sectional view of the push switch apparatus according to the related art.

In FIG. 9, a boss 11*a* is provided at a ceiling portion of a cap-shaped key top 11, and an upper end of a coil spring 12 is press-fitted into the boss 11*a*. Further, engaging protrusions 11*b* are provided at two places of a lower end of the key top 11. In an element switch 13, two metal pieces separated from each other are embedded in a bottom portion of a boxlike housing 14 such that portions of both metal pieces are exposed from an inner bottom surface of the housing 14 as fixed contacts 15 and 16. An inversion spring 17 is provided on the fixed contacts 15. The inversion spring 17 functions as a movable contact separated from the fixed contacts 16, and a dustproof sheet 18 is attached so as to be positioned to cover these contacts 15, 16, and 17. A lower end of the coil spring 12 is pressed against a central portion of the inversion spring 17 through the sheet 18.

In addition, an outer wall surface of the housing 14 functions as a slid surface of the key top 11, and removal preventing protrusions 14*a* are provided at two places of the outer wall surface so as to be engaged with the engaging protrusions 11*b*. Terminals that extend from the fixed contacts 15 and 16 protrude in a side direction of the housing 14 from the lower end of the housing 14, and a positioning protrusion 14*b* stands upright at the bottom surface of the housing 14.

The above-described key switch is surface-mounted on a printed board 20 by attaching the respective terminal 19 to land portions (not shown) via solders 21 after the positioning protrusion 14*b* of the housing 14 is fitted into a positioning hole 20*a* of the printed board 20.

In this key switch, the key top 11 can freely ascend and descend along the outer wall surface of the housing 14. If an operator presses the key top 11 by a predetermined amount, the lower end of the coil spring 12 causes the inversion spring 17 to be inverted, such that both the fixed contacts 15 and 16 are conducted to each other and the key switch is switched on. If the operator further presses the key top 11, the coil spring 12 is bent, thus an overstroke is obtained.

At this time, the operator feels a click due to the inversion movement of the inversion spring 17 through his finger. If the press is released from the key top 11, which is switched on, the inversion spring 17 is separated from the fixed contact 16 with its elasticity, and thus the key switch is switched off. Sequentially, the key top 11 ascends with resilience of the coil spring 12 and stops at the time when the engaging protrusion 11*b* is engaged with the removal preventing protrusion 14*a*.

However, in the structure of the conventional push switch apparatus, an initial spring pressure of the coil spring 12 is set smaller than the operation force of the inversion spring 17, and the inversion is made when the pressure against the key top 11 exceeds the operation force of the inversion spring 17. Accordingly, it is difficult to achieve the configuration in which the switch is pressed right at the beginning of the stroke, and then an overstroke is obtained. As a result, there is a problem in that the degree of freedom cannot be given in an operation mode.

In addition, if the initial pressure of the coil spring 12 exceeds the operation force of the inversion spring 17, the switch is unnecessarily switched on, even when the key top 11 is not pressed. Accordingly, the switch may be accidentally switched on by the variation in spring characteristic of the coil spring 12. Further, stroke may be varied until the switch is switched on.

SUMMARY OF THE INVENTION

Accordingly, the invention has been made to solve the above-described problems, and it is an object of the invention to provide a push switch apparatus which is capable of enhancing a pressure of an elastic member, switching a switch on at the beginning of a stroke, and then obtaining an overstroke.

In order to achieve the above-described objects, according to a first aspect of the invention, a push switch apparatus includes a switch that has a movable contact and a fixed contact built therein, a driving body that makes the movable contact contact/separate with/from the fixed contact by pressing the switch, an operating knob that holds the driving body, and a housing that holds the operating knob to be moved in a direction in which the switch is pressed. An elastic member that holds the driving body to be moved in the direction in which the switch is pressed and a stopper that regulates the movement of the driving body are provided in the operating knob, and the driving body elastically comes into contact with the stopper by the elastic member.

Further, according to a second aspect of the invention, elastic press force at an initial position of the elastic member that elastically presses the driving body may be set larger than operation force that is required to connect the contacts of the switch with each other.

Further, according to a third aspect of the invention, the driving body and the elastic member may be integrally formed in the operating knob.

Further, according to a fourth aspect of the invention, the operating knob may be formed in a box shape that has side walls facing each other. A tongue may be provided at one side wall through a notch, the driving body may be formed at a front end of the tongue, and the stopper may be formed at a lower portion of the other side wall. The elastic member may be constituted by bending the tongue. The driving body may elastically come into contact with the stopper by elastic force of the tongue.

Further, according to a fifth aspect of the invention, the driving body and the elastic member may be formed separately from the operating knob, and the driving body may elastically come into contact with the stopper by the elastic member.

Further, according to a sixth aspect of the invention, the elastic member may be formed with a coil spring.

BRIEF DESCRIPTION OF THE DRAWINGS

FIG. 4 is a cross-sectional view showing a state in which the push switch apparatus of the invention is switched on;

FIG. 5 is a cross-sectional view showing an overstroke state after the push switch apparatus of the invention is switched on;

FIG. 7 is a cross-sectional view showing a state in which the push switch apparatus according to another embodiment of the invention is switched on;

FIG. 8 is a cross-sectional view showing an overstroke state after the push switch apparatus according to another embodiment of the invention is switched on.

DESCRIPTION OF THE PREFERRED EMBODIMENT

Figure 1:
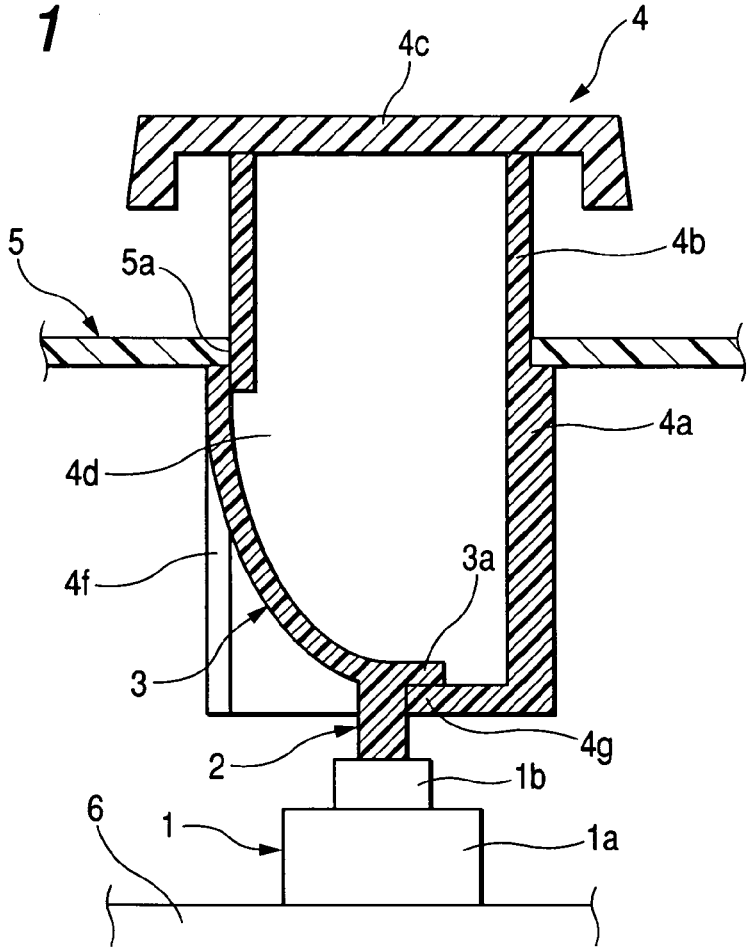
FIG. 1 is a cross-sectional view showing a push switch apparatus of the invention.
Figure 2:
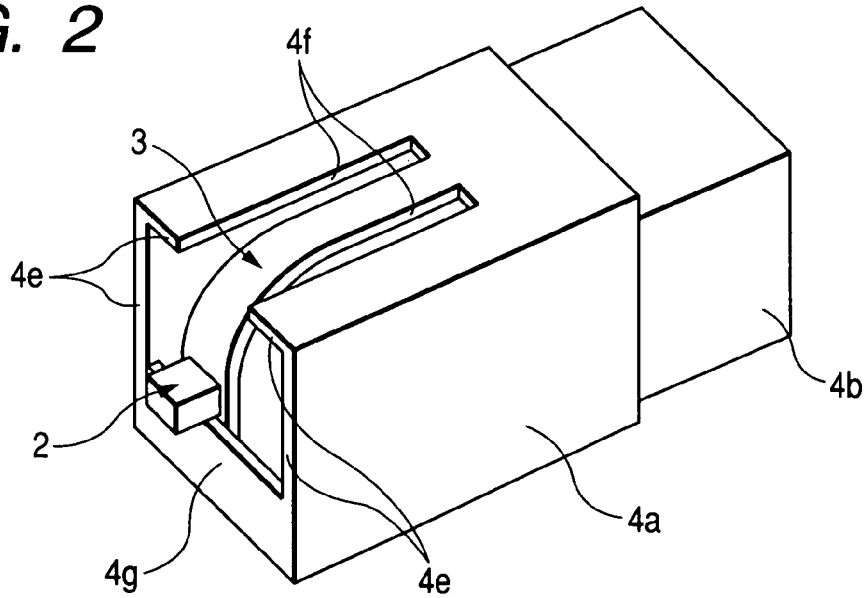
FIG. 2 is a perspective view showing an operating knob of the push switch apparatus of the invention.
Figure 3:
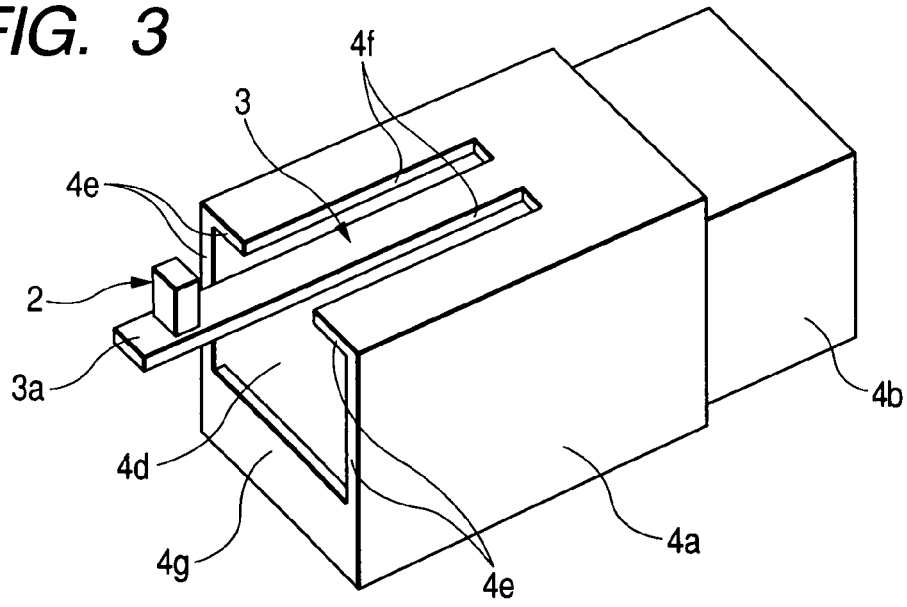
FIG. 3 is a perspective view showing a state before a tongue of the operating knob of the invention is bent.
Figure 4:
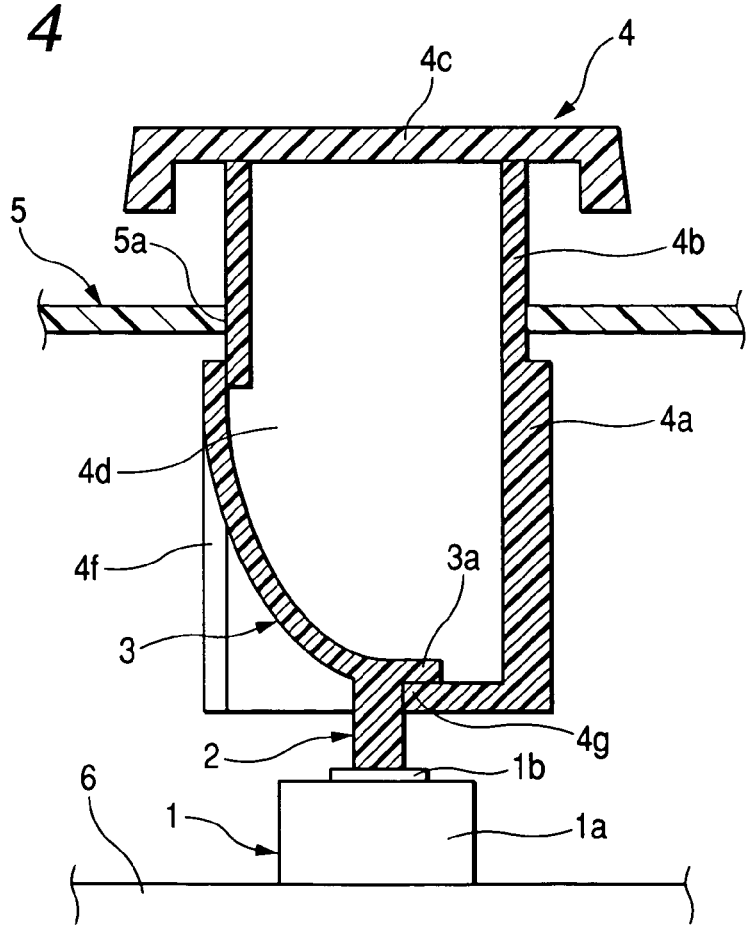
Figure 5:
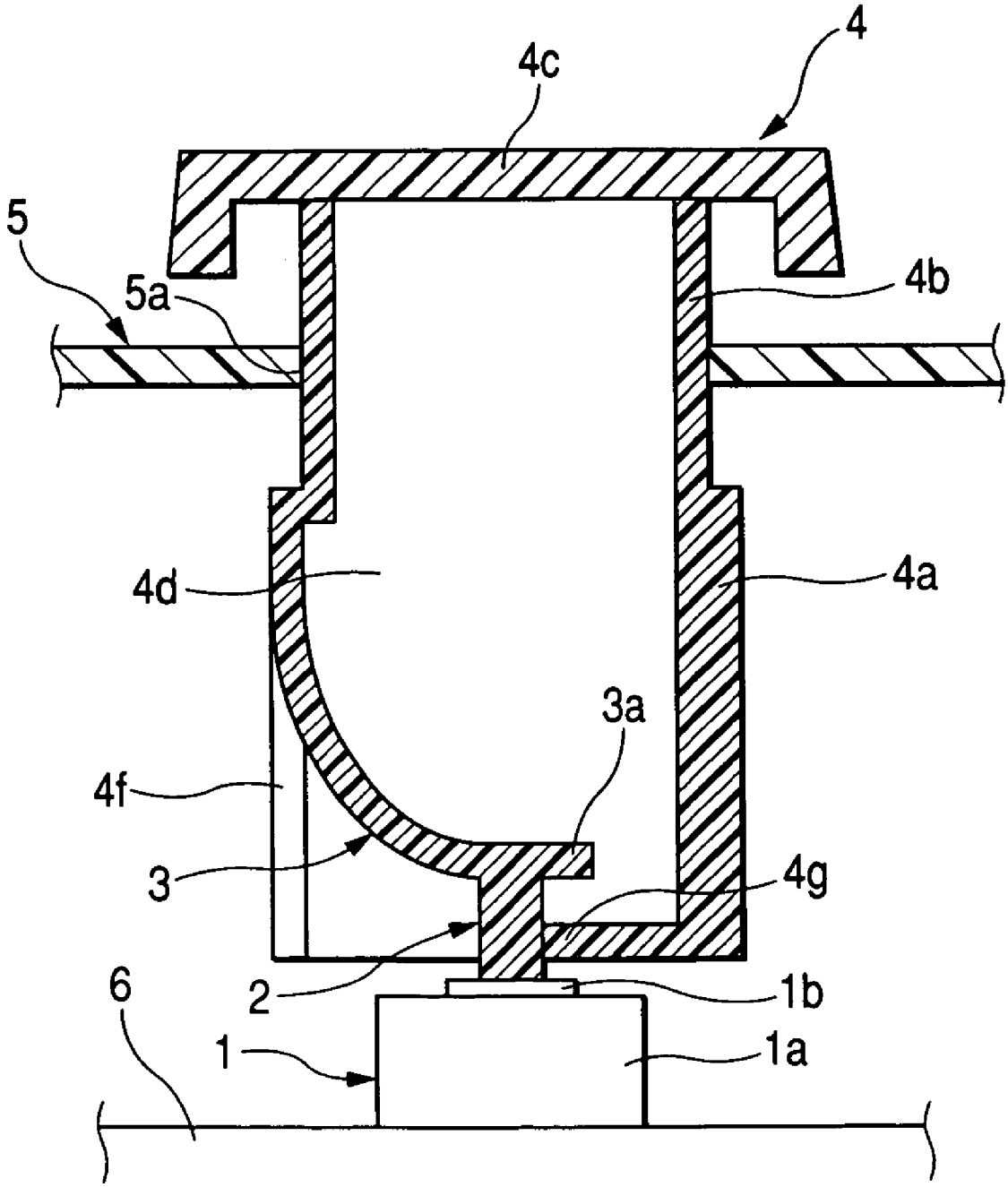
Figure 6:
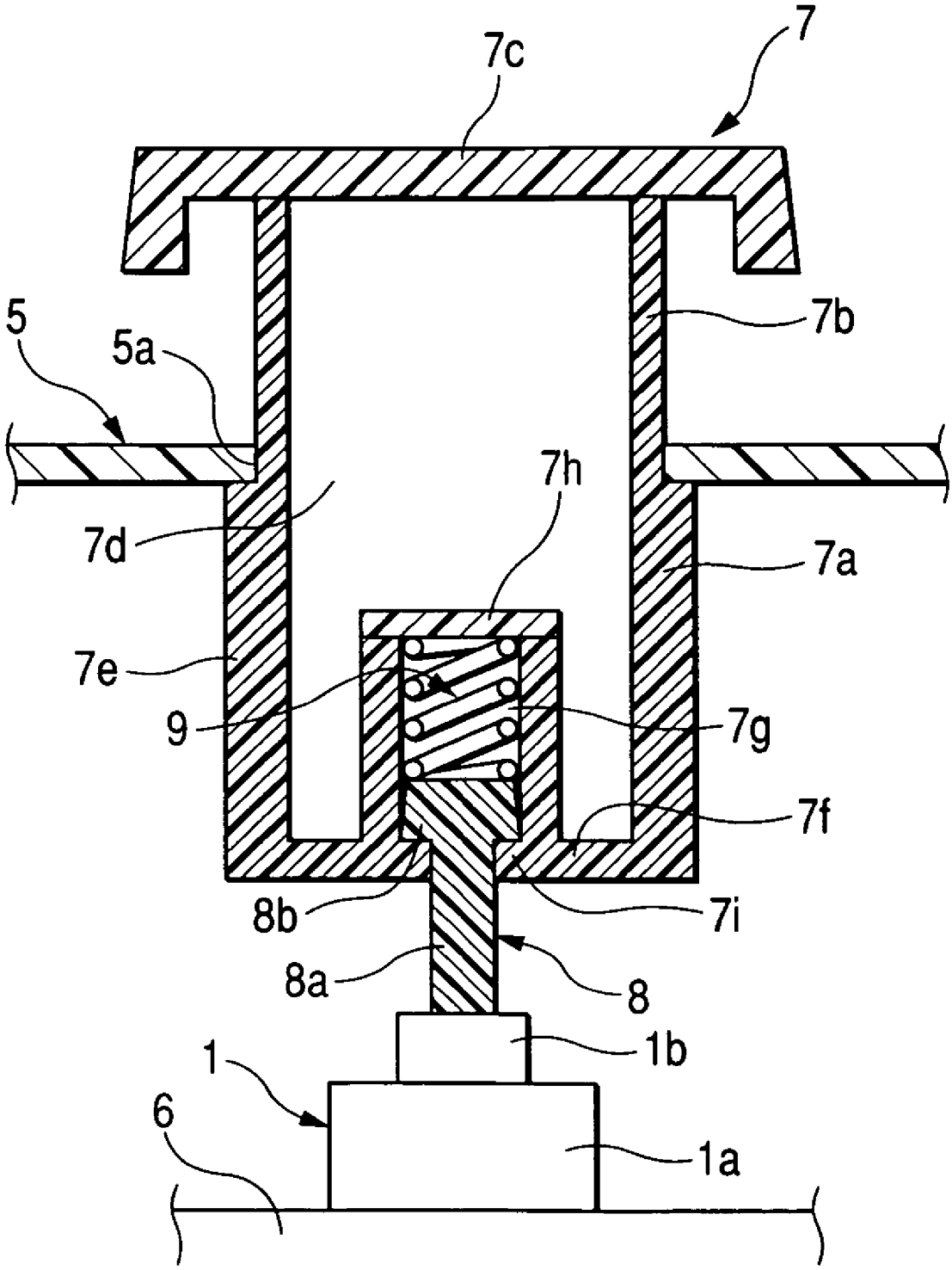
FIG. 6 is a cross-sectional view showing a push switch apparatus according to another embodiment of the invention.
Figure 7:
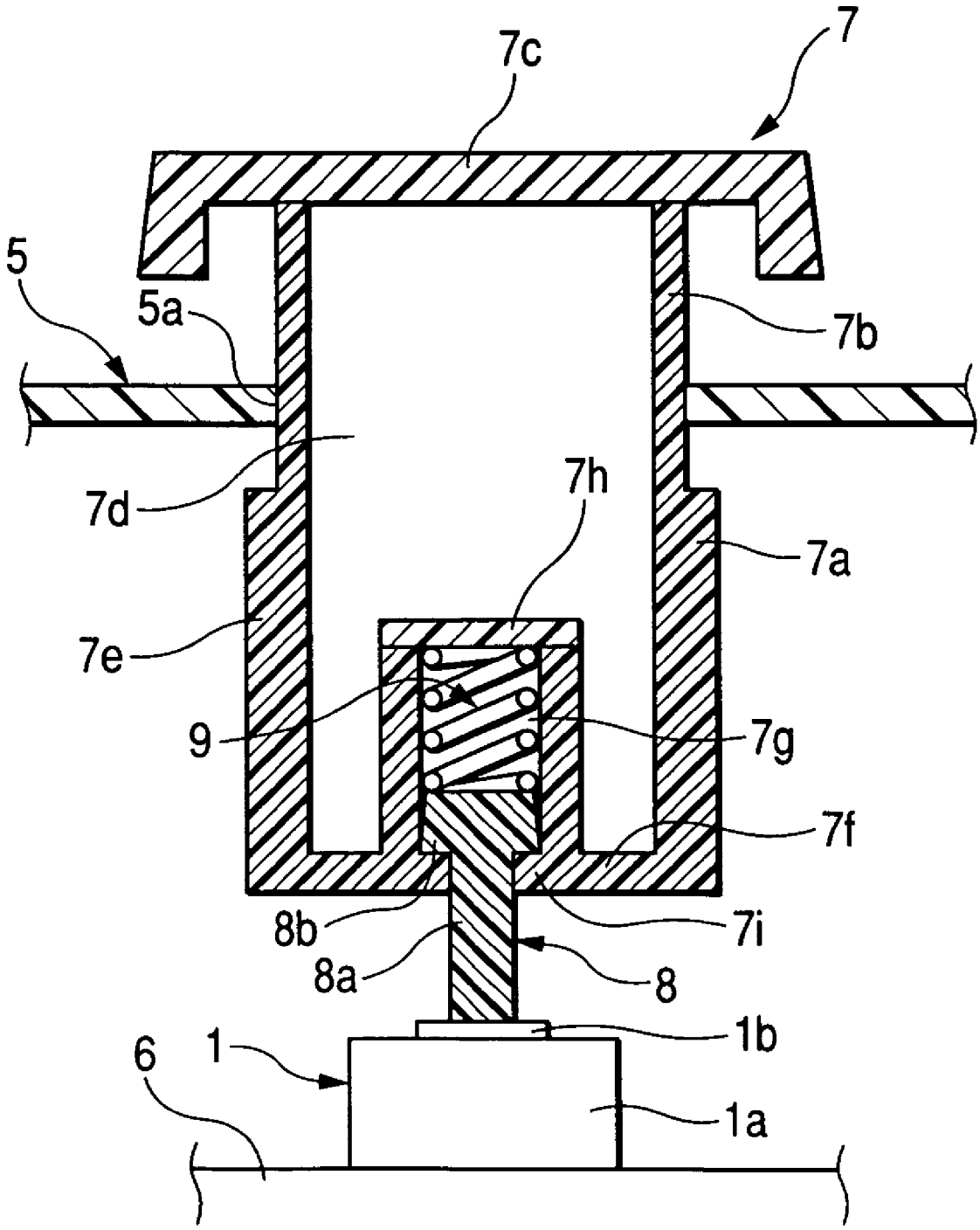
Figure 8:
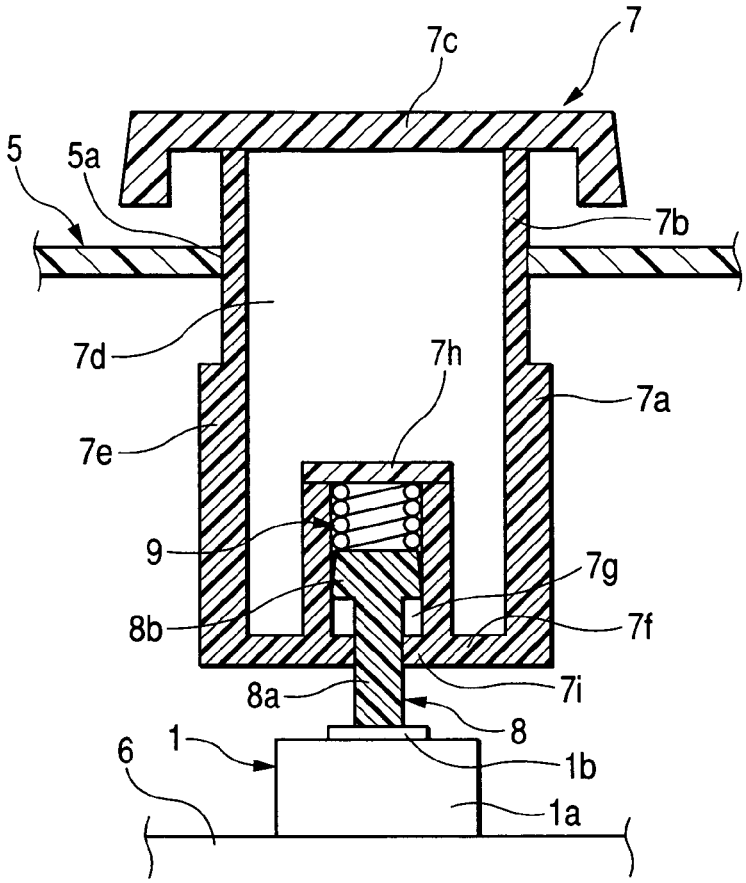
Figure 9:
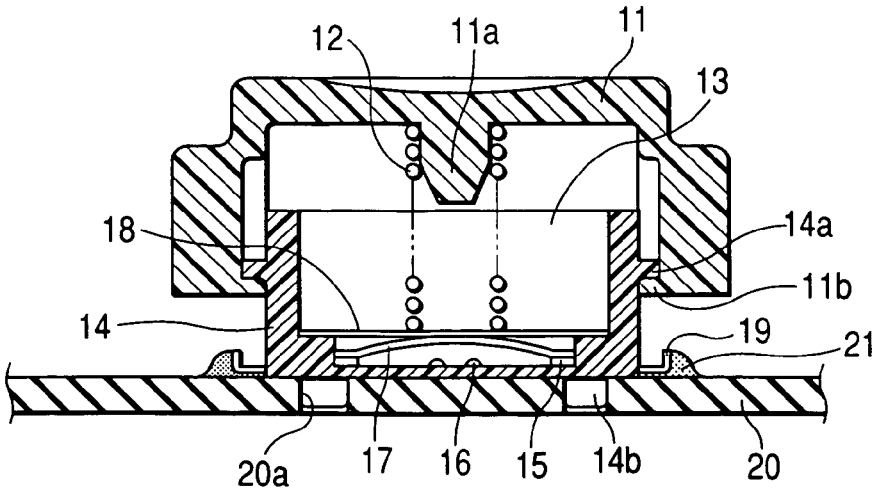
FIG. 9 PRIOR ART
FIG. 9 is a cross-sectional view showing a push switch apparatus according to the related art.

Hereinafter an embodiment of a push switch apparatus of the invention will be shown in FIGS. 1 to 8. FIG. 1 is a cross-sectional view of a push switch apparatus of the invention. FIG. 2 is a perspective view of an operating knob of the push switch apparatus of the invention. FIG. 3 is a perspective view showing a state before a tongue of the operating knob of the invention is bent. FIG. 4 is a cross-sectional view showing a state in which the push switch apparatus of the invention is switched on. FIG. 5 is a cross-sectional view of an overstroke state after the push switch apparatus of the invention is switched on. FIG. 6 is a cross-sectional view of a push switch apparatus according to another embodiment of the invention. FIG. 7 is a cross-sectional view showing a state in which the push switch apparatus according to another embodiment of the invention is switched on. FIG. 8 is a cross-sectional view showing an overstroke state after the push switch apparatus according to another embodiment of the invention is switched on.

In FIG. 1, the push switch apparatus of the invention primarily includes a switch 1 that has contacts built therein, a driving body 2 that pressingly drives the switch, an elastic member 3 that elastically presses the driving body 2, an operating knob 4 that holds the driving body 2 and the elastic member 3, and a housing 5 that holds the operating knob 4 so as to be moved in a direction in which the switch 1 is pressed.

The switch 1 has an existing push button switch, such as a tact switch or the like, and has a housing 1*a* and a push button 1*b*. A fixed contact (not shown), and a movable contact having an inversion spring which contacts/separates from the fixed contact so as to switch the switch 1 on/off are built in the housing 1*a*. The push button 1*b* is held so as to be moved along a longitudinal direction of the housing 1*a*. By pressing the movable contact with a lower end of the push button 1*b*, the movable contact is inverted so as to come into contact with the fixed contact.

As shown in FIGS. 1 to 3, the operating knob 4 is made of insulating materials, such as a synthetic resin or the like, and is formed in a rectangular box shape having a hollow part 4*d* therein. The operating knob 4 has a base 4*a* of a large rectangular shape, a knob part 4*b* of a small rectangular shape, which protrudes above the base 4*a*, and an upper plate part 4*c* that is provided at an upper end of the knob part 4*b*.

In the base 4*a*, four side walls 4*e* are provided at an outer circumference of the hollow part 4*d*, and a long tongue 3 is formed at one side wall 4*e* of a pair of side walls 4*e* and 4*e* facing each other. The tongue 3 extends outside the base 4 through a pair of notches 4*f* and 4*f*. A driving body 2 is formed at a front end of the tongue 3. The driving body 2 protrudes outside the side wall 4*e*, that is, in a direction perpendicular to the surface of the tongue 3. A stopper 4*g* is formed below the other side wall 4*e* of the pair of side walls 4*e* and 4*e* facing each other. The stopper 4*g* extends inside the side wall 4*e*, that is, in a direction perpendicular to the side wall 4*e*.

As shown in FIG. 3, the operating knob 4 is integrally molded such that the tongue 3 is bendable while extending outside the base 4*a*. Then, as shown in FIG. 2, an end surface 3*a* disposed in the vicinity of the driving body 2 formed at the front end of the tongue 3 is engaged with the stopper 4*g* by bending the tongue 3 inside the hollow part 4*d* of the base 4*a* through elastic force of the tongue 3. Therefore, the driving body 2 is integrally formed while elastically coming in contact with the stopper 4*g* through the elastic force of the tongue 3. That is, an elastic member that elastically presses the driving body 2 is constituted by the tongue 3. The driving body 2 is held by the operating knob 4 so as to be moved in a direction in which the switch 1 is pressed.

In such a manner, since the driving body 2 and the tongue 3 serving as the elastic member are integrally formed in the operating knob 4, it is possible to unitize the driving body 2, the elastic member (the tongue 3), and the operating knob 4, which enables ease of assembling.

The operating knob 4 is formed in a box shape having the side walls 4*e* facing each other. The tongue 3 is provided at one side wall 4*e* via the notch 4*f*, the driving body 2 is formed at the front end of the tongue 3, and the stopper 4*g* is formed below the other side wall 4*e* of the pair of side walls 4*e* and 4*e* facing each other. The elastic member is constituted by bending the tongue 3. The driving body 2 is held by the operating knob 4 so as to be moved in the direction in which the switch 1 is pressed. Since, the driving body 2 elastically comes into contact with the stopper 4*g* through the elastic force of the tongue 3, and thus unitization can be obtained by a simple structure, and the number of components can be reduced.

The housing 5 is made of an insulating material, such as a synthetic resin or the like, and an insertion hole 5*a*, into which the knob part 4*b* of the operating knob 4 is inserted, is formed at the top surface of the housing 5. The operating knob 4 is inserted into the insertion hole 5*a* so as to be moved vertically. In addition, the switch 1 disposed on the circuit board 6 is disposed in the housing 5 below the operating knob 4. The switch 1 elastically comes into contact with the stopper 4*g*, which is disposed below the base 4*a* of the operating knob 4, such that the front end of the driving body 2, which protrudes downward, comes into contact with the top surface of the push button 1*b* of the switch 1.

Next, the operation of the push switch apparatus of the invention will be described with reference to FIGS. 4 and 5.

First, at an initial state shown in FIG. 1, in a state in which the front end of the driving body 2 of the operating knob 4 comes into contact with the top surface of the push button 1*b* of the switch 1, the knob part 4*b* of the operating knob 4 protrudes from the top surface of the housing 5 up to a predetermined height by spring pressure of the inversion spring built in the housing 1*a* of the switch 1.

At this moment, as shown in FIG. 4, if the upper plate part 4*c* of the operating knob 4 is pressed downward, the operating knob 4 moves downward, such that the push button 1*b* of the switch 1 is pressed by the front end of the driving body 2. Sequentially, the movable contact (not shown) having the inversion spring built in the housing 1*a* is pressed by the push button 1*b*, and then the movable contact is inverted, such that the movable contact comes into contact with the fixed contact (not shown) and the switch is switched on.

In this case, the maximum operation force required to invert the movable contact so as to switch the switch 1 on, that is, inversion pressure of the movable contact having the inversion spring is set smaller than the elastic press force of the tongue 3 serving as the elastic member at the initial position. The elastic press force at the initial position elastically presses the driving body 2 against the stopper 4*g*. For this reason, the driving body 2 is moved while elastically coming into contact with the stopper 4*g*. In addition, even when the elastic press force of the tongue 3 at the initial position is set larger than the inversion pressure of the movable contact, with the stopper 4*g*, the driving body 2 is prevented from being moved, and thus the push button 1*b* of the switch 1 is not pressed at the initial state. Therefore, the switch 1 is prevented from being switched on.

Next, as shown in FIG. 5, if the operating knob 4 is further pressed downward from the state of FIG. 4, the movable contact comes into contact with the fixed contact so as to switch the switch 1 on. In this state, the driving body 2 is separated from the stopper 4*g* by bending the tongue 3, and thus the driving body 2 is moved into the hollow part 4*d* of the base 4*a* of the operating knob 4. As a result, the operating knob 4 is further pressed downward so as to enter an overstroke state.

In such a manner, according to the push switch apparatus of the invention, when the operating knob 4 is pressed, the operating knob 4 reliably presses the switch 1 immediately at the initial state of the stroke such that the contacts are switched on, thereby obtaining the overstroke state.

FIG. 6 shows the configuration of a push switch apparatus according to another embodiment of the invention. The configuration of the present embodiment is different from the embodiment described in FIGS. 1 to 5 in that the configurations of the driving body 2 and the elastic member 3 provided in the knob 4 differ. The same parts as those of the above-described embodiment are represented by the same reference numerals and the descriptions thereof will be omitted.

In the present embodiment, an operating knob 7, a driving body 8, and an elastic member 9 are formed to be separated from one another.

The operating knob 7 is made of an insulating material, such as a synthetic resin or the like, and, similarly, has a base 7*a*, a knob part 7*b*, and an upper plate part 7*c*. Further, four side walls 7*e* are provided at an outer circumference of a hollow part 7*d*, like the above-described embodiment. However, the driving body 8 is made of an insulating material, such as a synthetic resin or the like, to be separated from the operating knob 7, and has a columnar driving part 8*a* and a blade-shaped engaging part 8*b*. The elastic member 9 is formed with a coil spring.

A bottom plate 7*f* is formed below the hollow part 7*d* of the operating knob 7, and a box-shaped housing part 7*g* and an upper cover 7*h* are formed at the center of the bottom plate 7*f*. A bottom surface of the housing part 7*g* constitutes a stopper 7*i* of the driving body 8. The driving body 8 and the elastic member 9 are housed in the housing part 7*g*. The elastic member 9 is bent by covering an opening of the housing part 7*g* with the upper cover 7*h*, and the engaging part 8*b* of the driving body 8 elastically comes into contact with the stopper 7*i* by elastic force of the elastic member 9. The driving body 8 is held by the operating knob 7 so as to be moved in a direction, in which the switch 1 is pressed, by the elastic force of the elastic member 9.

Next, the operation of the push switch apparatus according to the present embodiment will be described with reference to FIGS. 7 and 8.

In an initial state shown in FIG. 6, in a state in which the front end of the driving body 8 of the operating knob 7 comes into contact with the top surface of the push button 1*b* of the switch 1, the knob part 7*b* of the operating knob 7 protrudes from the top surface of the housing 5 up to a predetermined height by spring pressure of the inversion spring built in the housing 1*a* of the switch 1.

At this time, as shown in FIG. 7, if the upper plate part 7*c* of the operating knob 7 is pressed downward, the operating knob 7 is moved downward, such that the push button 1*b* of the switch 1 is pressed by the front end of the driving body 8. Sequentially, the movable contact (not shown) having the inversion spring built in the housing 1*a* is pressed by the push button 1*b*, and then the movable contact is inverted. Next, the movable contact comes into contact with the fixed contact (not shown), such that the switch is switched on.

In this case, the maximum operation force required to invert the movable contact so as to switch the switch 1 on, that is, inversion pressure of the movable contact having the inversion spring is set smaller than the elastic press force of the elastic member 9 at the initial position. The elastic press force at the initial position elastically presses the driving body 8 against the stopper 7*i*. For this reason, the driving body 8 is moved while elastically coming into contact with the stopper 7*i*. In addition, even when the elastic press force of the elastic member 9 at the initial position is set larger than the inversion pressure of the movable contact (the inversion spring), with the stopper 7*i*, the driving body 8 is prevented from being moved. Therefore, the push button 1*b* of the switch 1 is not pressed at the initial state, such that the switch 1 is prevented from being switched on.

Next, as shown in FIG. 8, if the operating knob 4 is further pressed downward from the state of FIG. 7, the movable contact comes into contact with the fixed contact so as to switch the switch 1 on. In this state, the fixed part 8*b* of the driving body 8 is separated from the stopper 7*i* by bending the elastic member 9, and thus the driving part 8*a* the driving body 8 is moved into the housing part 7*g* of the base 7*a* of the operating knob 7. As a result, the operating knob 7 is further pressed downward so as to enter an overstroke state.

In such a manner, according to the push switch apparatus of the invention, when the operating knob 7 is pressed, the operating knob 7 reliably presses the switch 1 immediately at the initial state of the stroke such that the movable contact comes into contact with the fixed contact. Sequentially, the overstroke state is obtained. Since the driving body 8 and the elastic member 9 are formed separately from the operating knob 7, and the driving body 8 elastically comes into contact with the stopper 7*i*, standardization of the operating knob 7 can be realized by changing the elastic member 9, and the pressure of the elastic member 9 can be easily changed. Therefore, various strokes can be easily handled at the time of pressing. In addition, since the elastic member 9 is formed with the coil spring, the pressure can be easily set, and thus a stable pressure can be obtained.

Further, in the description of the embodiment, the coil spring is used as the elastic member 9. However, an air tank may be formed by sealing the housing part 7*g*, the driving body 8 may be made of a synthetic resin having flexibility, such as an elastomer or the like, so as to form an air sealing part therearound, and elastic force which elastically presses the driving body 8 can be obtained by air pressure of the air tank part.

According to the embodiments of the invention, the driving body 2 or 8 is held by the operating knob 4 or 7 so as to be moved in the direction in which the switch 1 is pressed, and the elastic member 3 or 9 that elastically presses the driving body 2 or 8 and the stopper 4*g* or 7*i*, while preventing the driving body 2 or 8 from being moved, are provided. The driving body 2 or 8 is elastically comes into contact with the stopper 4*g* or 7*i* with the elastic member 3 or 9. Therefore, even when the driving body 2 or 8 is pressed in the initial state, the pressure required to switch the switch 1 on is not applied due to the stopper 4*g* or 7*i*. For this reason, the pressure to be applied by the elastic member 3 or 9 can be enhanced at the initial position. Accordingly, it is possible to provide the push switch apparatus which can switch the switch 1 on at a portion close to the initial state of the stroke, as compared with the related art, and then enters the overstroke operation.

As described above, the push switch apparatus includes the switch that has the movable contact and the fixed contact built therein, the driving body that makes the movable contact contact/separate with/from the fixed contact by pressing the switch, the operating knob that holds the driving body, and the housing that holds the operating knob to be moved in a direction in which the switch is pressed. The elastic member that holds the driving body so as to be moved in the direction in which the switch is pressed and suppresses the driving body and the stopper that regulates the movement of the driving body are provided in the operating knob. The driving body elastically comes into contact with the stopper by the elastic member. Therefore, even when a pressure is applied to the driving body at an initial state, a pressure for driving the switch is not applied due to the stopper, and thus the pressure by the elastic member at an initial position can be enhanced. Accordingly, it is possible to provide the push switch apparatus which can easily switch the switch on at a portion close to the beginning of the stroke, as compared with the related art, and then enter an overstroke operation.

In addition, the elastic press force at the initial position of the elastic member that elastically presses the driving body is set larger than the operation force that is required to connect the contacts of the switch with each other. Therefore, when the operating knob is pressed, the switch reliably operates immediately at the portion close to the beginning of the stroke and then enters the overstroke operation.

In addition, since the driving body and the elastic member are integrally formed in the operating knob, it is possible to unitize the driving body, the elastic member, and the operating knob, which enables ease of assembling.

Further, the operating knob is formed in the box shape that has side walls facing each other. The tongue is provided at one side wall through the notch, the driving body is formed at the front end of the tongue, and the stopper is formed at the lower portion of the other side wall. The elastic member is constituted by bending the tongue. The driving body elastically comes into contact with the stopper by the elastic force of the tongue. Accordingly, unitization can be obtained with a simple structure, and the number of components can be reduced.

In addition, the driving body and the elastic member are formed separately from the operating knob, and the driving body elastically comes into contact with the stopper by the elastic member. Therefore, standardization of the operating knob can be realized, and the pressure of the elastic member can be easily changed. As a result, various strokes can be easily handled at the time of pressing.

Further, since the elastic member is formed with the coil spring, the pressure can be easily set, and thus a stable pressure can be obtained.

The invention claimed is:

1. A push switch apparatus comprising:

a switch that has a movable contact and a fixed contact built therein;

a driving body that makes the movable contact either separate from or contact the fixed contact by pressing the switch;

an operating knob that holds the driving body; and a housing that holds the operating knob to be moved in a direction in which the switch is pressed, wherein an elastic member that holds the driving body so as to be moved in the direction in which the switch is pressed and suppresses the driving body and a stopper that regulates the movement of the driving body are provided in the operating knob, the driving body elastically comes into contact with the stopper by the elastic member, and wherein an elastic press force at an initial position of the elastic member that elastically presses the driving body is larger than an operation force to connect the contacts of the switch with each other.

2. The push switch apparatus according to claim 1, wherein the driving body and the elastic member are integrally formed in the operating knob.

3. The push switch apparatus according to claim 2, wherein the operating knob is formed in a box shape that has side walls facing each other, a tongue is provided at one side wall through a notch, the driving body is formed at a front end of the tongue, and the stopper is formed at a lower portion of the other side wall, the elastic member is constituted by bending the tongue, and the driving body elastically comes into contact with the stopper by elastic force of the tongue.

4. The push switch apparatus according to claim 1, wherein the driving body and the elastic member are formed separately from the operating knob, and the driving body elastically comes into contact with the stopper by the elastic member.

5. The push switch apparatus according to claim 4, wherein the elastic member is formed with a coil spring.

6. A push switch apparatus comprising:

a switch that has a movable contact and a fixed contact built therein;

a driving body that makes the movable contact either separate from or contact the fixed contact by pressing the switch;

an operating knob that holds the driving body; and a housing that holds the operating knob to be moved in a direction in which the switch is pressed, wherein an elastic member that holds the driving body so as to be moved in the direction in which the switch is pressed and suppresses the driving body and a stopper that regulates the movement of the driving body are provided in the operating knob, the driving body elastically comes into contact with the stopper by the elastic member, and wherein the driving body and the elastic member are integrally formed in the operating knob.

7. The push switch apparatus according to claim 6, wherein the operating knob is formed in a box shape that has side walls facing each other, a tongue is provided at one side wall through a notch, the driving body is formed at a front end of the tongue, and the stopper is formed at a lower portion of the other side wall, the elastic member is constituted by bending the tongue, and the driving body elastically comes into contact with the stopper by elastic force of the tongue.

8. The push switch apparatus according to claim 6, wherein the driving body and the elastic member are formed separately from the operating knob, and the driving body elastically comes into contact with the stopper by the elastic member.

9. The push switch apparatus according to claim 8, wherein the elastic member is formed with a coil spring.

* * * * *